United States Patent [19]

Rapparini

[11] Patent Number: 4,562,691

[45] Date of Patent: Jan. 7, 1986

[54] VERTICAL PACKAGING MACHINE FOR BAGS WITH ERECTABLE SELF-SUPPORTING TENSILE STRUCTURE WITH FLAT BOTTOM

[76] Inventor: Gino Rapparini, viale Roma 17, I 40139 Bologna, Italy

[21] Appl. No.: 476,942

[22] Filed: Mar. 18, 1983

[30] Foreign Application Priority Data

Mar. 18, 1982 [IT] Italy ..... 3373 A/82

[51] Int. Cl.[4] ..... B65B 31/04

[52] U.S. Cl. ..... 53/552; 53/575

[58] Field of Search ..... 53/512, 551, 552, 567, 53/575

[56] References Cited

U.S. PATENT DOCUMENTS

Re. 27,302 2/1972 Schneider et al. ..... 53/551

3,325,961 6/1967 Lindh et al. ..... 53/551

4,004,398 1/1977 Larsson et al. ..... 53/551

FOREIGN PATENT DOCUMENTS 2051093 4/1972 Fed. Rep. of Germany ..... 53/552

*Primary Examiner*—Francis S. Husar

*Assistant Examiner*—Jorji M. Griffin

*Attorney, Agent, or Firm*—Sughrue, Mion, Zinn, Macpeak & Seas

[57] ABSTRACT

A machine for forming, filling and sealing bags from a flexible tubular web comprising a hollow rectangular mandrel over which the web passes, a pair of crimping jaws which crimp the web below the mandrel to form a flap, a knife mounted in at least one of the crimping jaws for severing the crimped web into individual bags, a shovel for folding the bottom flap of the bag and pressure heads for securing the ears to the sides of the bag.

2 Claims, 12 Drawing Figures

VERTICAL PACKAGING MACHINE FOR BAGS WITH ERECTABLE SELF-SUPPORTING TENSILE STRUCTURE WITH FLAT BOTTOM

BACKGROUND OF THE INVENTION

The present invention is directed to a vertical packaging machine for forming, filling, and sealing bags from a flexible elongated web which is wound on a reel wherein the bags have an erectable self-supporting tensile structure with a quadrangular flat bottom without side bellows, an upper sealing flap and triangular ears associated with the bottom and which are affixed to the side walls of the bag or against the flat bottom of the bag. The wedge-shaped structure of the bags, which are sequentially produced by the vertical packaging machine, provide an intrinsic stiffness which offers a maximum exhibit surface for advertising which will be maintained in the upright position.

Automatic vertical packaging machines are known which utilize a flat elongated web wound on a reel to form airtight, filled, sealed containers. The flat elongated web is wrapped about a hollow mandrel and is longitudinally sealed by means of a thin strip of heat sealing material covering the overlapping edges of the web to give the web a tubular configuration. Other prior art machines utilize an extruded tubular web which is free from longitudinal machines. Other known packaging machines have means for evacuating air from formed and filled bags before sealing the bag opening so as to achieve a certain degree of vacuum which remains even after the bag is sealed. Still other prior art packaging machines are provided for filling bags with sterilized substances such as long-life milk. The operation of these machines is carried out under conditions of absolute asepsis wherein the inner surface of the bag is sterilized and the filling and sealing operation takes place without any contact with the environmental atmosphere, thus producing an absolutely aseptic package, thereby guaranteeing the long life of the product.

Prior art packaging machines are known wherein the extruded tubular web or the seamed tubular web formed from a flat flexible web form, fill, and seal pillow-shaped bags with or without side bellows. Such bags have the disadvantage that they cannot stand for the exhibition of advertising for every single bag. At present, the trend is toward erectable packages having a self-supporting structure. Many flexible bags are provided with small additional bases so as to enable the bag to stand. Filling machines are also known to introduce sterilized milk or various other drinks into semi-flexible cartons. The cartons used in these machines are preshaped and fed horizontally from a magazine wherein the cartons are stacked in folded condition. In such prior art machines the carton is withdrawn and opened and then sterilized and filled with sterile liquids before being sealed under aseptic conditions.

Machines for carrying out the packaging of sterile liquids under aseptic conditions are also known wherein the packages are formed in a vertical array. Machines of this type give the container the form of a pillow with four protruding side ears. Afterwards, the filled pillows with the four side ears still protruding therefrom are conveyed to separate units which turn over the four side ears and fix them to the side walls or top of the bag, thus giving the bags the form of cushion-parallelopiped containers. Such machines involve a very complex sequence of operations.

SUMMARY OF THE INVENTION

The present invention is directed to a vertical packaging machine for sequentially producing bags which are capable of standing by themselves even when empty.

The present invention is directed to a vertical packaging machine for sequentially producing self-supporting bags each having a flat bottom with the triangular ears associated therewith being folded against the flat bottom or against the sides of the bag and having an upper sealing flap formed simultaneously with the triangular ears of an adjacent bag so that the finished bag does not have any side bellows. Such wedge-shaped bags have an intrinsic stiffness which offers a maximum exhibit surface which can be maintained in the upright position due to the flat bottom construction.

The foregoing and other objects, features, and advantages of the invention will be apparent from the following description of a preferred embodiment of the invention as illustrated in the accompanying drawings.

DETAILED DESCRIPTION OF THE INVENTION

Figure 1:
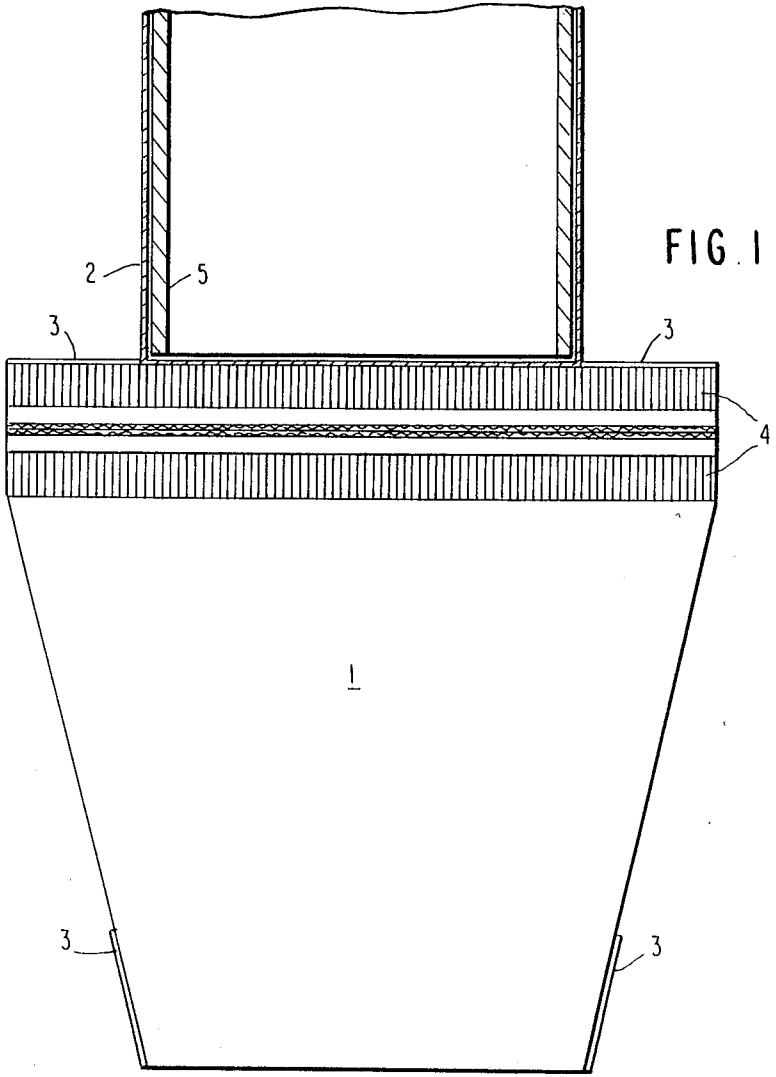
FIG. 1 is a schematic view showing a formed, filled and sealed bag in attached relation to the subsequent bag still on the hollow mandrel.

As best seen in FIG. 1, a tubular web of material 2 passes downwardly over a hollow rectangular mandrel 5 and a bag 1 is formed by means of a crimping operation which takes place at the lower end of the mandrel 5. As a result of the crimping operation, upper and lower flaps 4 are simultaneously formed across the width of the tubular web 2. The flaps 4 are still joined together as viewed in FIG. 1, with one of the flaps 4 closing the upper end of the bag 1 and the other flap 4 forming the lower closed end of the next succeeding bag. Since the crimping operation takes place immediately adjacent the bottom of the mandrel 5, a pair of laterally protruding ears 3 are formed on each side of the mandrel. As shown at the bottom of FIG. 1, the ears, which were formed with respect to the bag 1, have been folded upwardly and secured to the sides of the bag 1.

Figure 3:
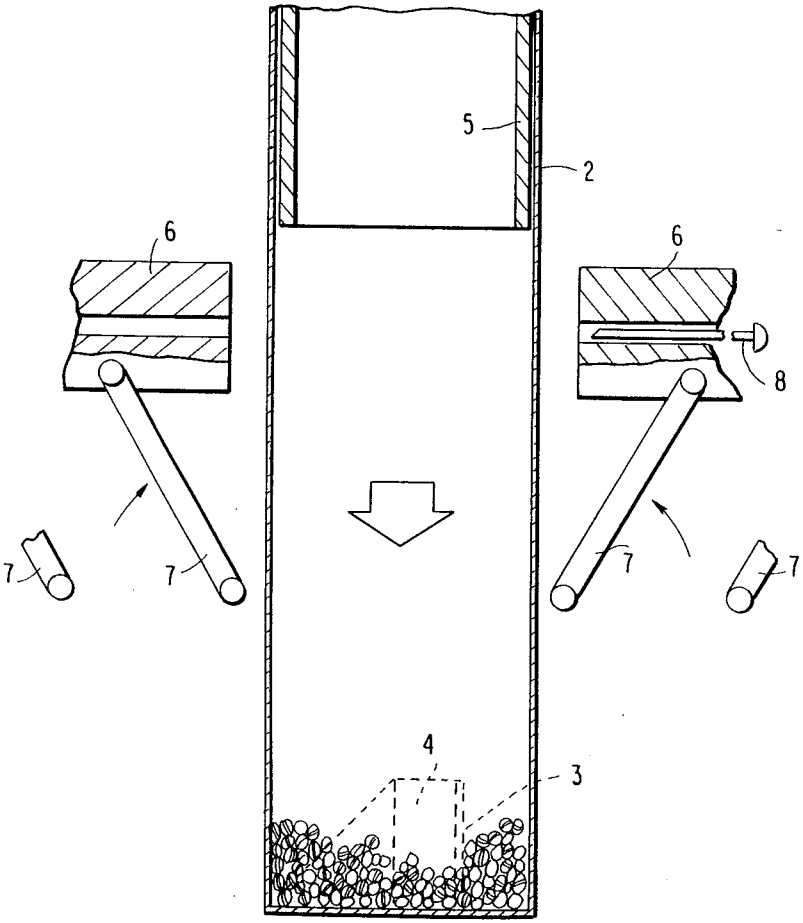
FIG. 3 is a front elevation view of the tubular web disposed between opposed crimping jaws prior to being sealed.

FIG. 3 shows the pair of identical crimping jaws 6 which are pivotally supported by means of pivot arms 7 on the frame of the machine for movement towards and away from the tubular web 2 as it moves below the mandrel 5. The arms 7 form a parallelogram linkage for accurately guiding the crimping jaws towards each other adjacent the bottom of the mandrel 5. A cutting tool 8 is mounted for reciprocating movement within one of the jaws 6. Means for moving the crimping jaws 6 and the cutting tool 8 are well known in the art and it is not deemed necessary to illustrate such mechanisms in detail in the present application.

As shown in FIG. 3, a previous crimping operation has formed a closure at the lower end of the tubular web 2 and, using conventional filling means, a suitable product may be introduced through the hollow mandrel 5 into the bag which depends below the lowermost end of the mandrel 5.

Figure 2:
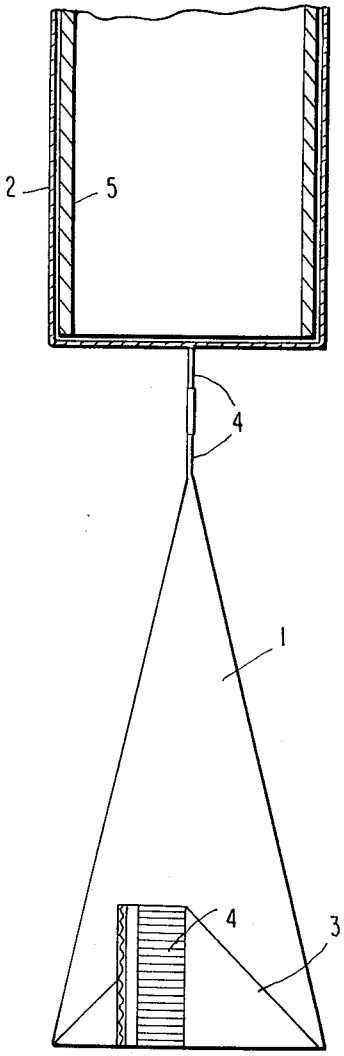
FIG. 2 is a side elevation view of a package as viewed in FIG. 1.
Figure 4:
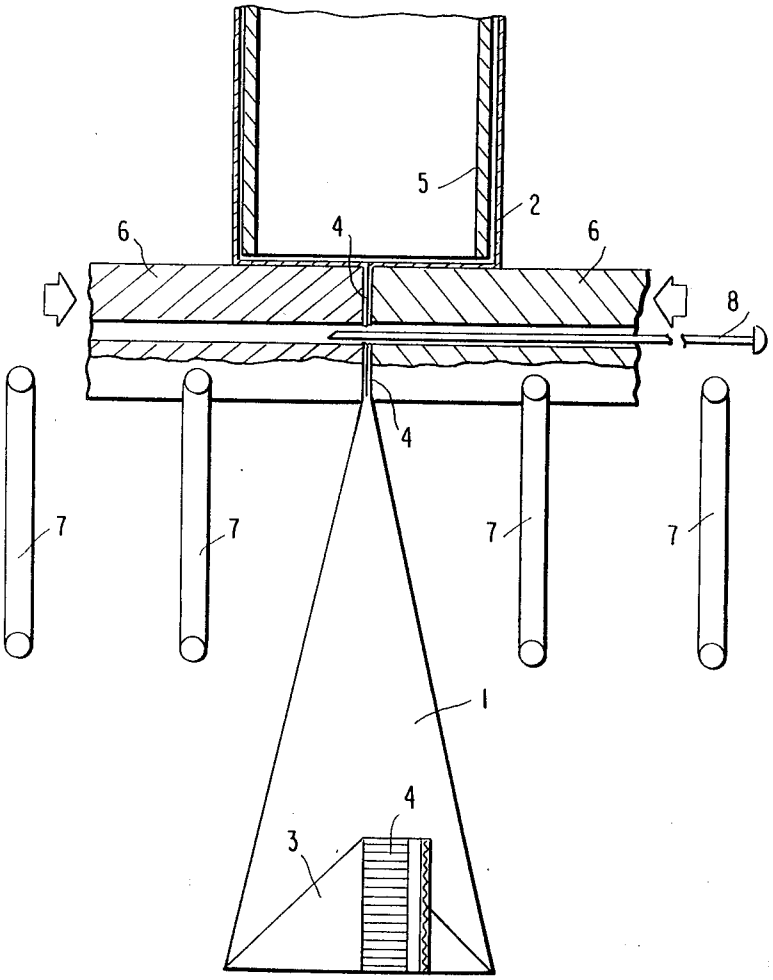
FIG. 4 is a view similar to FIG. 3 with the crimping jaws moved into operative sealing engagement with the tubular web.
Figure 6:
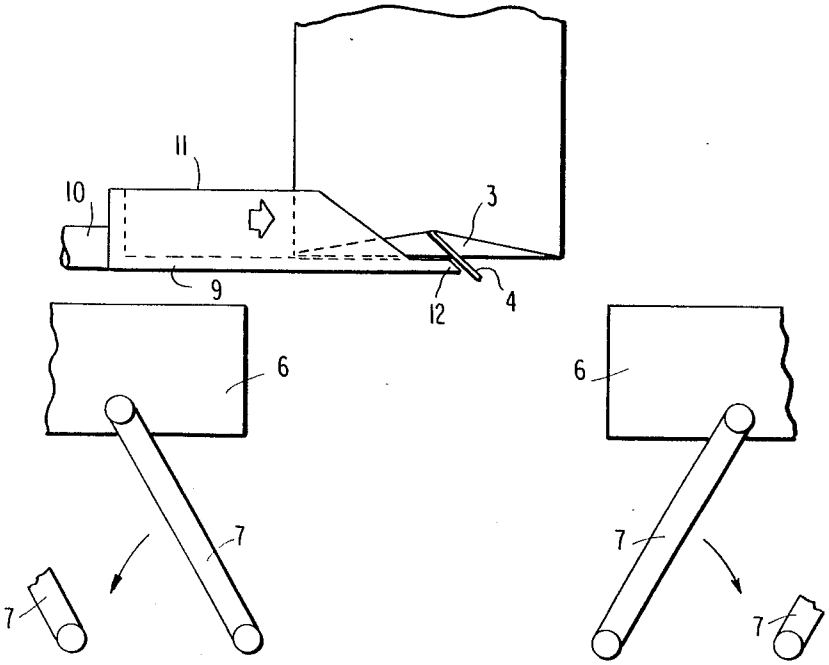
FIG. 6 is a view similar to FIG. 5 but with the crimping jaws completely retracted and the shovel initiating the folding of the flap on the bottom of the bag on the mandrel.
Figure 5:
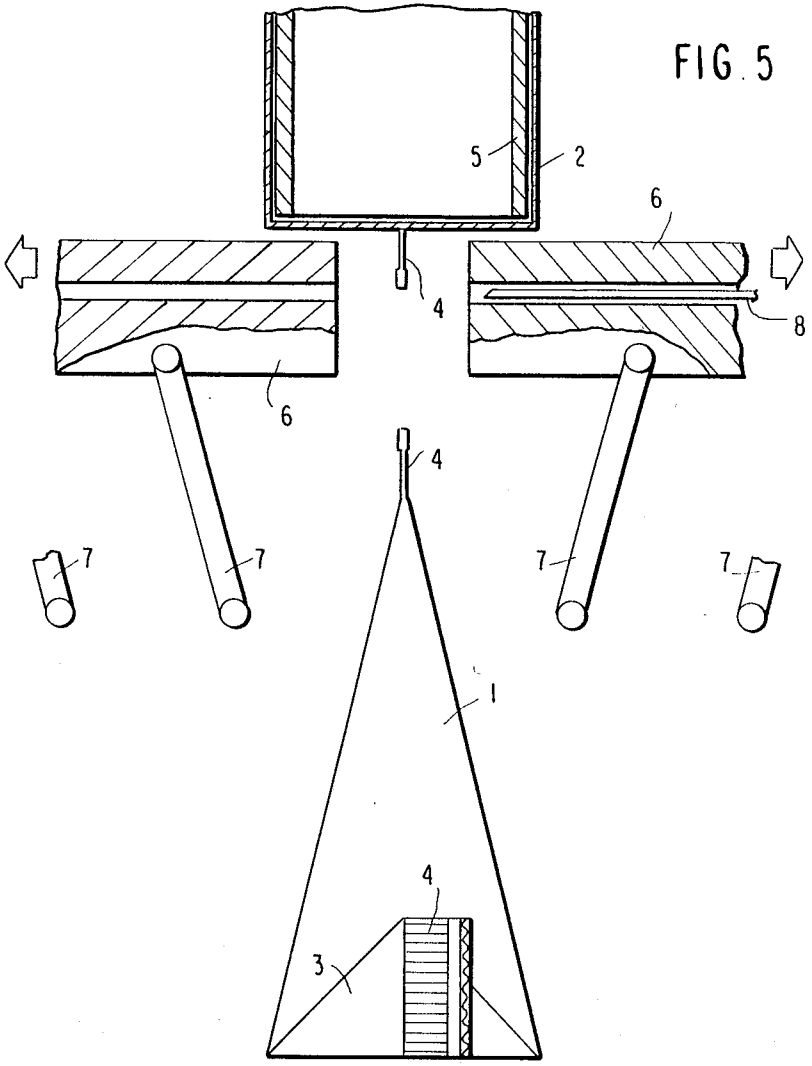
FIG. 5 is a view similar to FIG. 4 with the crimping jaws removed and the formed bag severed from the subsequent bag still on the mandrel.
Figure 9:
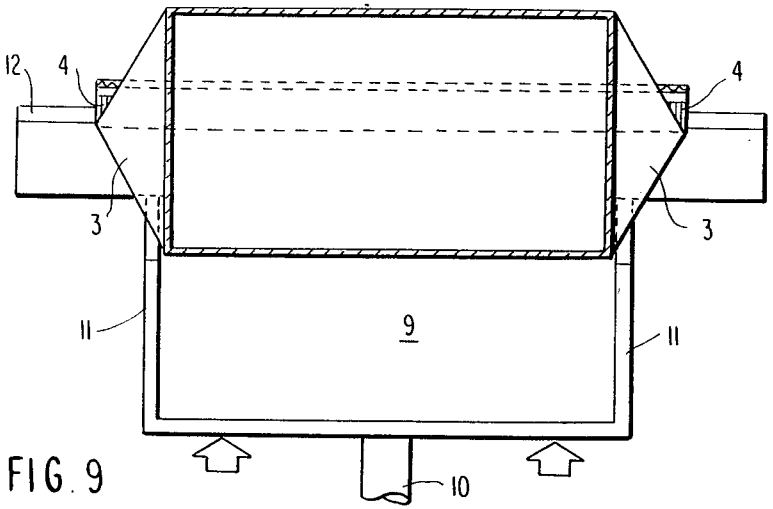
FIG. 9 is a plan view, partly in section, showing the shovel in the position shown in FIG. 7.

After the bag 1 has been filled, the crimping jaws 6 are brought into sealing engagement against the tubular web 2, as best seen in FIG. 4. Due to the arcuate pivotal movement of the jaws 6, the bottom of the bag still on the mandrel 5 is formed and the tubular web is crimped to form the lower flap of the bag still on the mandrel and the upper flap of the just filled bag 1. Actuation of a knife, as shown in FIG. 4, severs the web joining the two flaps 4 together so that upon retraction of the jaws, as shown in FIG. 6, the bag 1, which is completely sealed, is free to fall into a suitable receiving means. The tubular web 2 remains in the position shown in FIG. 2 with the lower flap 4 protruding downwardly from the formed bottom of the next bag to be filled.

Figure 10:
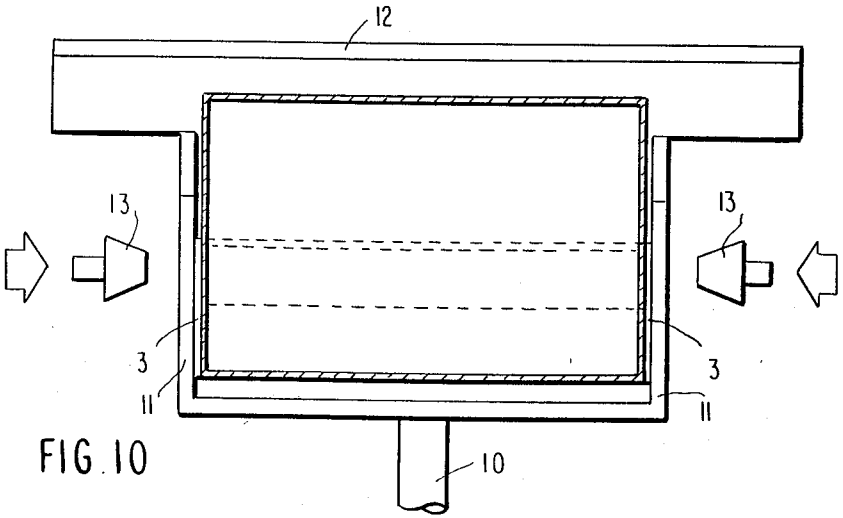
FIG. 10 is a plan view, partly in section showing the shovel in the position shown in FIG. 8 and the relationship of the pusher relative thereto.
Figure 7:
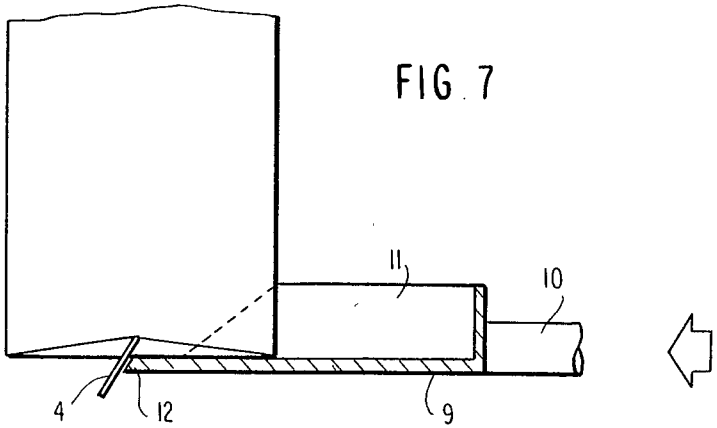
FIG. 7 is a side view similar to FIG. 6 showing the shovel in section.
Figure 8:
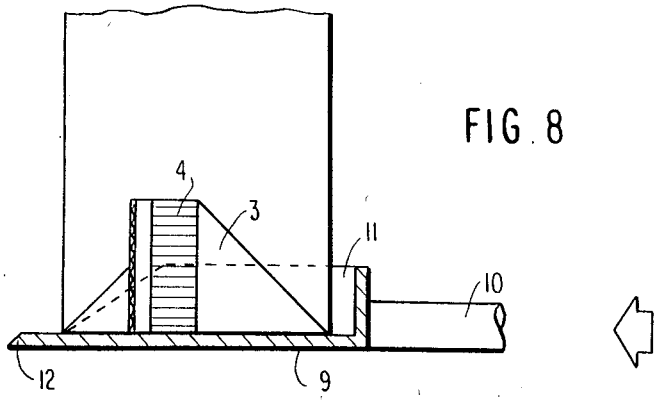
FIG. 8 is a view figure similar to FIG. 7 wherein the flaps have been folded upwardly by contact with the sides of the shovel.

A shovel member 11, carried by an actuating rod 10, is then moved laterally into position above the retracted jaws 6, as best seen in FIG. 6. The shovel is provided with a beveled front end portion 12 which engages the downwardly depending flap and folds it upwardly against the bottom of the bag which is still on the lower end of the mandrel. As the shovel continues its lateral movement across the bottom of the mandrel, the side walls of the shovel 11 engage the ears or flaps 3 which protrude laterally outwardly beyond the side of the mandrel and fold the ears or flaps 3 upwardly into engagement with the sides of the tubular web which will be the sides of the next bag being formed. With the ears 3 disposed against the side of the tubular web, as seen in FIGS. 8 and 10, a pair of pushers 13, as shown in FIG. 10, are moved against the ears from opposite directions to press the ears against the side walls of the web or bag. Glue may be applied to the ears 3 before the folding operation, so that the pressure of the pushers 13 will cause the ears 3 to become adhered to the sidewalls of the bag. The means for applying the glue have not been illustrated since such glue applicators are old and well known in the art. Another possibility of permanently sealing the ears 3 against the sides of the bag is by heat sealing. For example, a blast of hot air may be directed against the ears in the folded condition and, depending upon the type of material involved, the ears will be fused to the bag. Once the ears 3 have been sealed to the bag, the shovel is withdrawn and the tubular web 2, is extended by suitable means (not shown) to position the web as shown in FIG. 3 for the filling of the bag and the subsequent closing of the top portion of the bag. The means for moving the shovel 11 have not been illustrated, but such mechanical means are well within the knowledge of one skilled in the art.

Figure 12:
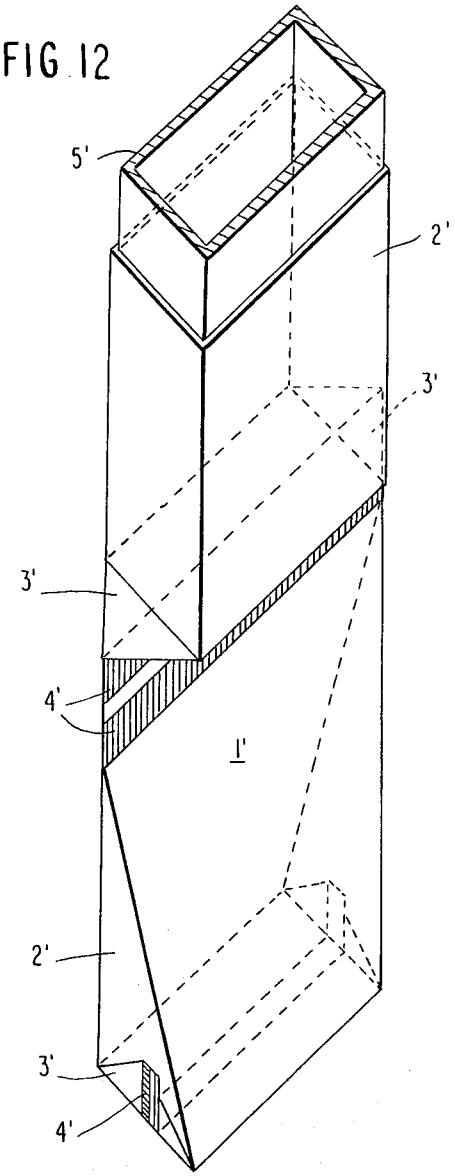
FIG. 12 is a perspective view showing a modified form of bag construction relative to the forming mandrel.
Figure 11:
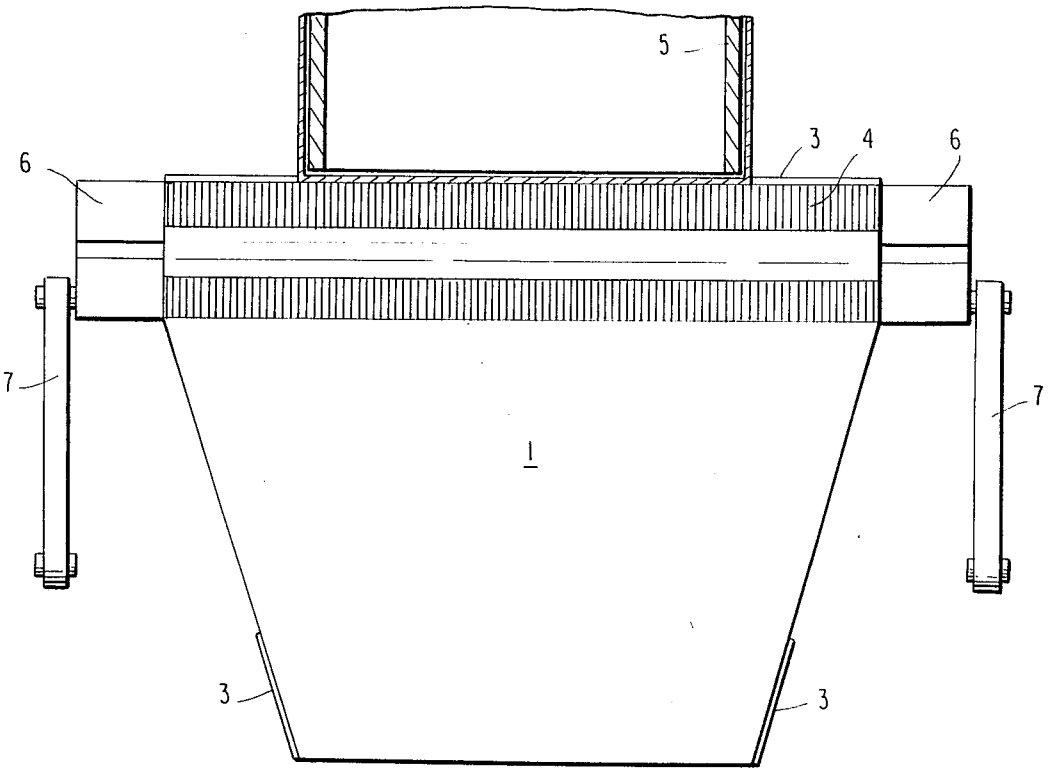
FIG. 11 is a view similar to FIG. 1 showing one of the crimping heads in position.

A modified form of bag construction is shown in FIG. 12, which utilizes the exact same principles used in the formation of the bag 1 shown in FIG. 1. The mandrel 5' in FIG. 12 enables the bags to be filled under aseptic conditions to form wedge-shaped packages with the ears 3' turned up and fixed to the bag body.

The various drives for the crimping jaws, the cutting tool, the shovel and the pressure heads can be hydraulically or pneumatically operated or may be of the electromagnetic type. The film for the thin tubular web can be of the pre=sterilized type or covered by a thin sterile film which can be peeled upon packaging. The film can be made up of layers, including aluminum foils which can be sealed with electrical induction, ultrasonics, with radio frequency, with laser arrays, or with laser plasma. The systems for sterilizing the bag can be of any desired type, with or without using hydrogen peroxide, ethyl alcohol or other means well known in the art of sterilization.

While the invention has been particularly shown and described with respect to a preferred embodiment thereof, it will be understood by those in the art that various changes in form and detail may be made therein without departing from the spirit and scope of the invention.

I claim:

1. A vertical packaging machine comprising a frame, a vertically disposed hollow rectangular mandrel adapted to have a tubular web pass downwardly thereover, a pair of opposed crimping jaws pivotally mounted on said frame below said mandrel for lateral movement transversely of said mandrel for crimping the tubular web across the entire width thereof against the bottom of said mandrel to form a vertically disposed sealed flap, cutting means mounted for lateral reciprocation in at least one of said jaws for severing the formed flap into upper and lower sealed portions, laterally moveable shovel means on said frame moveable across the bottom of said mandrel for folding said upper sealed flap portion into a horizontal position and folding the laterally extending portions of the flap upwardly against the sides of the tubular web on said mandrel and a pair of opposed pressure heads on said frame laterally moveable against said folded up portions to secure said folded up portions to the sides of said tubular web.

2. A vertical packaging machine as set forth in claim 1 wherein said shovel means is comprised of a flat horizontally disposed blade adapted to extend under the entire mandrel and a pair of upwardly extending portions on opposite sides thereof spaced from each other by a distance slightly greater than the width of said mandrel.

* * * * *